US006565713B2

(12) United States Patent
Hansen et al.

(10) Patent No.: US 6,565,713 B2
(45) Date of Patent: May 20, 2003

(54) LAMINATED STRUCTURE FOR PAPER MACHINE PRESS FABRIC AND METHOD MAKING

(75) Inventors: Robert A. Hansen, Stuttgart-Birkach (DE); Maurice R. Paquin, Westborough, MA (US)

(73) Assignee: Albany International Corp., Albany, NY (US)

( * ) Notice: Subject to any disclaimer, the term of this patent is extended or adjusted under 35 U.S.C. 154(b) by 12 days.

(21) Appl. No.: 09/776,049

(22) Filed: Feb. 3, 2001

(65) Prior Publication Data

US 2002/0104631 A1 Aug. 8, 2002

(51) Int. Cl.[7] ..... D21F 7/08

(52) U.S. Cl. ..... 162/358.2; 156/184; 428/37; 162/900

(58) Field of Search ..... 139/383 A, 425 A, 139/383 AA; 162/306, 348, 358.2, 358.4, 900, 901, 902, 903, 904; 156/137, 141, 143, 168, 149, 166, 184, 188, 189, 190, 192, 195; 428/37, 192, 193; 442/239, 240, 246, 247, 255, 268, 270

(56) References Cited

U.S. PATENT DOCUMENTS

| | | | | |
|---|---|---|---|---|
| 4,427,734 A | | 1/1984 | Johnson | 442/324 |
| 4,944,820 A | * | 7/1990 | McCarten | 156/154 |
| 5,202,170 A | * | 4/1993 | Hsu et al. | 162/358.2 |
| 5,268,076 A | | 12/1993 | Best et al. | 162/358.2 |
| 5,360,656 A | | 11/1994 | Rexfelt et al. | 428/193 |
| 5,525,410 A | | 6/1996 | Hansen | 442/197 |
| 5,785,818 A | * | 7/1998 | Fekete et al. | 139/383 AA |
| 5,837,080 A | * | 11/1998 | Grondahl | 156/137 |
| 5,968,318 A | * | 10/1999 | Hasegawa et al. | 162/358.4 |
| 6,162,518 A | * | 12/2000 | Korfer | 139/383 AA |

FOREIGN PATENT DOCUMENTS

| | | |
|---|---|---|
| EP | 0 802 280 A2 | 4/1997 |
| EP | 1 063 349 A2 | 3/2000 |

* cited by examiner

*Primary Examiner*—Steven P. Griffin
*Assistant Examiner*—Eric Hug
(74) *Attorney, Agent, or Firm*—Frommer Lawrence & Haug, LLP; Ronald R. Santucci

(57) ABSTRACT

A press fabric is manufactured by spirally winding a strip in a plurality of non-overlapping abutting turns, and by joining each turn of the strip to that previously wound. The strip is itself a laminated structure having at least two layers attached to one another. The strip is manufactured in considerable lengths for subsequent use in manufacturing press fabrics in any length and width dimension.

36 Claims, 3 Drawing Sheets

LAMINATED STRUCTURE FOR PAPER MACHINE PRESS FABRIC AND METHOD MAKING

BACKGROUND OF THE INVENTION

1. Field of the Invention

The present invention relates to the papermaking arts. More specifically, the present invention relates to press fabrics for the press section of a paper machine.

2. Description of the Prior Art

During the papermaking process, a cellulosic fibrous web is formed by depositing a fibrous slurry, that is, an aqueous dispersion of cellulose fibers, onto a moving forming fabric in the forming section of a paper machine. A large amount of water is drained from the slurry through the forming fabric, leaving the cellulosic fibrous web on the surface of the forming fabric.

The newly formed cellulosic fibrous web proceeds from the forming section to a press section, which includes a series of press nips. The cellulosic fibrous web passes through the press nips supported by a press fabric, or, as is often the case, between two press fabrics. In the press nips, the cellulosic fibrous web is subjected to compressive forces which squeeze water therefrom, and which adhere the cellulose fibers in the web to one another to turn the cellulosic fibrous web into a paper sheet. The water is accepted by the press fabric or fabrics and, ideally, does not return to the paper sheet.

The paper sheet finally proceeds to a dryer section, which includes at least one series of rotatable dryer drums or cylinders, which are internally heated by steam. The newly formed paper sheet is directed in a serpentine path sequentially around each in the series of drums by a dryer fabric, which holds the paper sheet closely against the surfaces of the drums. The heated drums reduce the water content of the paper sheet to a desirable level through evaporation.

It should be appreciated that the forming, press and dryer fabrics all take the form of endless loops on the paper machine and function in the manner of conveyors. It should further be appreciated that paper manufacture is a continuous process which proceeds at considerable speeds. That is to say, the fibrous slurry is continuously deposited onto the forming fabric in the forming section, while a newly manufactured paper sheet is continuously wound onto rolls after it exits from the dryer section.

The present invention relates specifically to the press fabrics used in the press section. Press fabrics play a critical role during the paper manufacturing process. One of their functions, as implied above, is to support and to carry the paper product being manufactured through the press nips.

Press fabrics also participate in the finishing of the surface of the paper sheet. That is, press fabrics are designed to have smooth surfaces and uniformly resilient structures, so that, in the course of passing through the press nips, a smooth, mark-free surface is imparted to the paper.

Perhaps most importantly, the press fabrics accept the large quantities of water extracted from the wet paper in the press nip. In order to fill this function, there literally must be space, commonly referred to as void volume, within the press fabric for the water to go, and the fabric must have adequate permeability to water for its entire useful life. Finally, press fabrics must be able to prevent the water accepted from the wet paper from returning to and rewetting the paper upon exit from the press nip.

Contemporary press fabrics are produced in a wide variety of styles designed to meet the requirements of the paper machines on which they are installed for the paper grades being manufactured. Generally, they comprise a woven base fabric into which has been needled a batt of fine, nonwoven fibrous material. The base fabrics may be woven from monofilament, plied monofilament, multifilament or plied multifilament yarns, and may be single-layered, multi-layered or laminated. The yarns are typically extruded from any one of the synthetic polymeric resins, such as polyamide and polyester resins, used for this purpose by those of ordinary skill in the paper machine clothing arts.

The woven base fabrics themselves take many different forms. For example, they may be woven endless, or flat woven and subsequently rendered into endless form with a woven seam. Alternatively, they may be produced by a process commonly known as modified endless weaving, wherein the widthwise edges of the base fabric are provided with seaming loops using the machine-direction (MD) yarns thereof. In this process, the MD yarns weave continuously back-and-forth between the widthwise edges of the fabric, at each edge turning back and forming a seaming loop. A base fabric produced in this fashion is placed into endless form during installation on a paper machine, and for this reason is referred to as an on-machine-seamable fabric. To place such a fabric into endless form, the two widthwise edges are brought together, the seaming loops at the two edges are interdigitated with one another, and a seaming pin or pintle is directed through the passage formed by the interdigitated seaming loops.

Further, the woven base fabrics may be laminated by placing one base fabric within the endless loop formed by another, and by needling a staple fiber batt through both base fabrics to join them to one another. One or both woven base fabrics may be of the on-machine-seamable type.

In any event, the woven base fabrics are in the form of endless loops, or are seamable into such forms, having a specific length, measured longitudinally therearound, and a specific width, measured transversely thereacross. Because paper machine configurations vary widely, paper machine clothing manufacturers are required to produce press fabrics, and other paper machine clothing, to the dimensions required to fit particular positions in the paper machines of their customers. Needless to say, this requirement makes it difficult to streamline the manufacturing process, as each press fabric must typically be made to order.

In response to this need to produce press fabrics in a variety of lengths and widths more quickly and efficiently, press fabrics have been produced in recent years using a spiral technique disclosed in commonly assigned U.S. Pat. No. 5,360,656 to Rexfelt et al., the teachings of which are incorporated herein by reference.

U.S. Pat. No. 5,360,656 shows a press fabric comprising a base fabric having one or more layers of staple fiber material needled thereinto. The base fabric comprises at least one layer composed of a spirally wound strip of woven fabric having a width which is smaller than the width of the base fabric. The base fabric is endless in the longitudinal, or machine, direction. Lengthwise threads of the spirally wound strip make an angle with the longitudinal direction of the press fabric. The strip of woven fabric may be flat-woven on a loom which is narrower than those typically used in the production of paper machine clothing.

The base fabric comprises a plurality of spirally wound and joined turns of the relatively narrow woven fabric strip. The fabric strip is woven from lengthwise (warp) and crosswise (filling) yarns. Adjacent turns of the spirally wound fabric strip may be abutted against one another, and the helically continuous seam so produced may be closed by sewing, stitching, melting or welding. Alternatively, adjacent longitudinal edge portions of adjoining spiral turns may be arranged overlappingly, so long as the edges have a reduced thickness, so as not to give rise to an increased thickness in the area of the overlap. Further, the spacing between lengthwise yarns may be increased at the edges of the strip, so that, when adjoining spiral turns are arranged overlappingly, there may be an unchanged spacing between lengthwise threads in the area of the overlap.

In any case, a woven base fabric, taking the form of an endless loop and having an inner surface, a longitudinal (machine) direction and a transverse (cross-machine) direction, is the result. The lateral edges of the woven base fabric are then trimmed to render them parallel to its longitudinal (machine) direction. The angle between the machine direction of the woven base fabric and the helically continuous seam may be relatively small, that is, typically less than 100. By the same token, the lengthwise (warp) yarns of the woven fabric strip make the same relatively small angle with the longitudinal (machine) direction of the woven base fabric. Similarly, the crosswise (filling) yarns of the woven fabric strip, being perpendicular to the lengthwise (warp) yarns, make the same relatively small angle with the transverse (cross-machine) direction of the woven base fabric. In short, neither the lengthwise (warp) nor the crosswise (filling) yarns of the woven fabric strip align with the longitudinal (machine) or transverse (cross-machine) directions of the woven base fabric.

In the method shown in U.S. Pat. No. 5,360,656, the woven fabric strip is wound around two parallel rolls to assemble the woven base fabric. It will be recognized that endless base fabrics in a variety of widths and lengths may be provided by spirally winding a relatively narrow piece of woven fabric strip around the two parallel rolls, the length of a particular endless base fabric being determined by the length of each spiral turn of the woven fabric strip, and the width being determined by the number of spiral turns of the woven fabric strip. The prior necessity of weaving complete base fabrics of specified lengths and widths to order may thereby be avoided. Instead, a loom as narrow as 20 inches (0.5 meters) could be used to produce a woven fabric strip, but, for reasons of practicality, a conventional textile loom having a width of from 40 to 60 inches (1.0 to 1.5 meters) may be preferred.

U.S. Pat. No. 5,360,656 also shows a press fabric comprising a base fabric having two layers, each composed of a spirally wound strip of woven fabric. Both layers take the form of an endless loop, one being inside the endless loop formed by the other. Preferably, the spirally wound strip of woven fabric in one layer spirals in a direction opposite to that of the strip of woven fabric in the other layer. That is to say, more specifically, the spirally wound strip in one layer defines a right-handed spiral, while that in the other layer defines a left-handed spiral. In such a two-layer, laminated base fabric, the lengthwise (warp) yarns of the woven fabric strip in each of the two layers make relatively small angles with the longitudinal (machine) direction of the woven base fabric, and the lengthwise (warp) yarns of the woven fabric strip in one layer make an angle with the lengthwise (warp) yarns of the woven fabric strip in the other layer. Similarly, the crosswise (filling) yarns of the woven fabric strip in each of the two layers make relatively small angles with the transverse (cross-machine) direction of the woven base fabric, and the crosswise (filling) yarns of the woven fabric strip in one layer make an angle with the crosswise (filling) yarns of the woven fabric strip in the other layer. In short, neither the lengthwise (warp) nor the crosswise (filling) yarns of the woven fabric strip in either layer align with the longitudinal (machine) or transverse (cross-machine) directions of the base fabric. Further, neither the lengthwise (warp) nor the crosswise (filling) yarns of the woven fabric strip in either layer align with those of the other.

As a consequence, the base fabrics shown in U.S. Pat. No. 5,360,656 have no defined machine- or cross-machine-direction yarns. Instead, the yarn systems lie in directions at oblique angles to the machine and cross-machine directions. A press fabric having such a base fabric may be referred to as a multi-axial press fabric. Whereas the standard press fabrics of the prior art have three axes: one in the machine direction (MD), one in the cross-machine direction (CD), and one in the Z-direction, which is perpendicularly through the thickness of the fabric, a multi-axial press fabric has not only these three axes, but also has at Least two more axes defined by the directions of the yarn systems in its spirally wound layer or layers. Moreover, there are multiple flow paths in the Z-direction of a multi-axial press fabric. As a consequence, a multi-axial press fabric has at least five axes. Because of its multi-axial structure, a multi-axial press fabric having more than one layer exhibits superior resistance to nesting and/or to collapse in response to compression in a press nip during the papermaking process as compared to one having base fabric layers whose yarn systems are parallel to one another.

Once a base fabric has been manufactured in accordance with the teachings of U.S. Pat. No. 5,360,656, other materials may be attached thereto in the form of additional layers. Most often, these additional layers comprise batts of staple fiber material attached to the base fabric by needling or hydroentangling. The staple fiber material forms the paper-supporting surface of the press fabric, and, where the base fabric has been laminated, individual fibers which have been driven through the laminated base fabric by the needling or hydroentangling are the means by which the layers are held together.

Moreover, layers of additional materials, such as apertured thermoplastic sheet material or nonwoven mesh fabrics, are frequently used to cover the base fabric before batts of staple fiber material are attached thereto. These additional materials are included, for example, as anti-rewet layers or to provide additional void volume for the temporary storage of water pressed from a paper web or a smoother, knuckle-free surface.

Clearly, the provision of these additional layers is made at the expense of additional manufacturing steps which, in the long run, use up much of the time saved by manufacturing the base fabric according to the teachings of U.S. Pat. No. 5,360,656. The present invention provides a means by which a press fabric may be manufactured more efficiently from a previously laminated structure in accordance with the teachings of this same patent.

SUMMARY OF THE INVENTION

Accordingly, the present invention is both a method for manufacturing a press fabric, and the press fabric product itself, wherein a laminated structure in the form of a strip is pre-manufactured and subsequently used to fashion press fabrics in specified lengths and widths according to a spiral winding technique.

The laminated structure comprises at least two layers: a top layer and a bottom layer, which are attached to one another in a sandwich-like fashion. The top layer, which ultimately supports a paper web in the press section of a paper machine, comprises one of the materials selected from the group consisting of: staple fiber material; fabric woven from fibers or filaments fine enough not to mark a wet paper web; spun-bond, hydroentangled and melt-blown nonwoven fabrics; and apertured extruded polymeric films.

The bottom layer comprises one of the materials selected from the group consisting of staple fiber material; fabric woven from fibers or filaments fine enough not to mark a wet paper web; spun-bond, hydroentangled and melt-blown nonwoven fabrics; apertured extruded polymeric films; knitted fabrics; nonwoven netting materials or mesh fabrics; and woven fabric strips.

The laminated structure may also comprise, between the top and bottom layers, an intermediate layer which comprises one of the materials identified above for the top or bottom layer.

The top layer, or the top and intermediate layers, are attached to the bottom layer by needling, melting, fusing, gluing or the like, and the resulting laminated structure stored for subsequent use in manufacturing press fabrics.

The present invention will now be described in more complete detail with frequent reference being made to the figures identified below.

DETAILED DESCRIPTION OF THE PREFERRED EMBODIMENT

Figure 1:
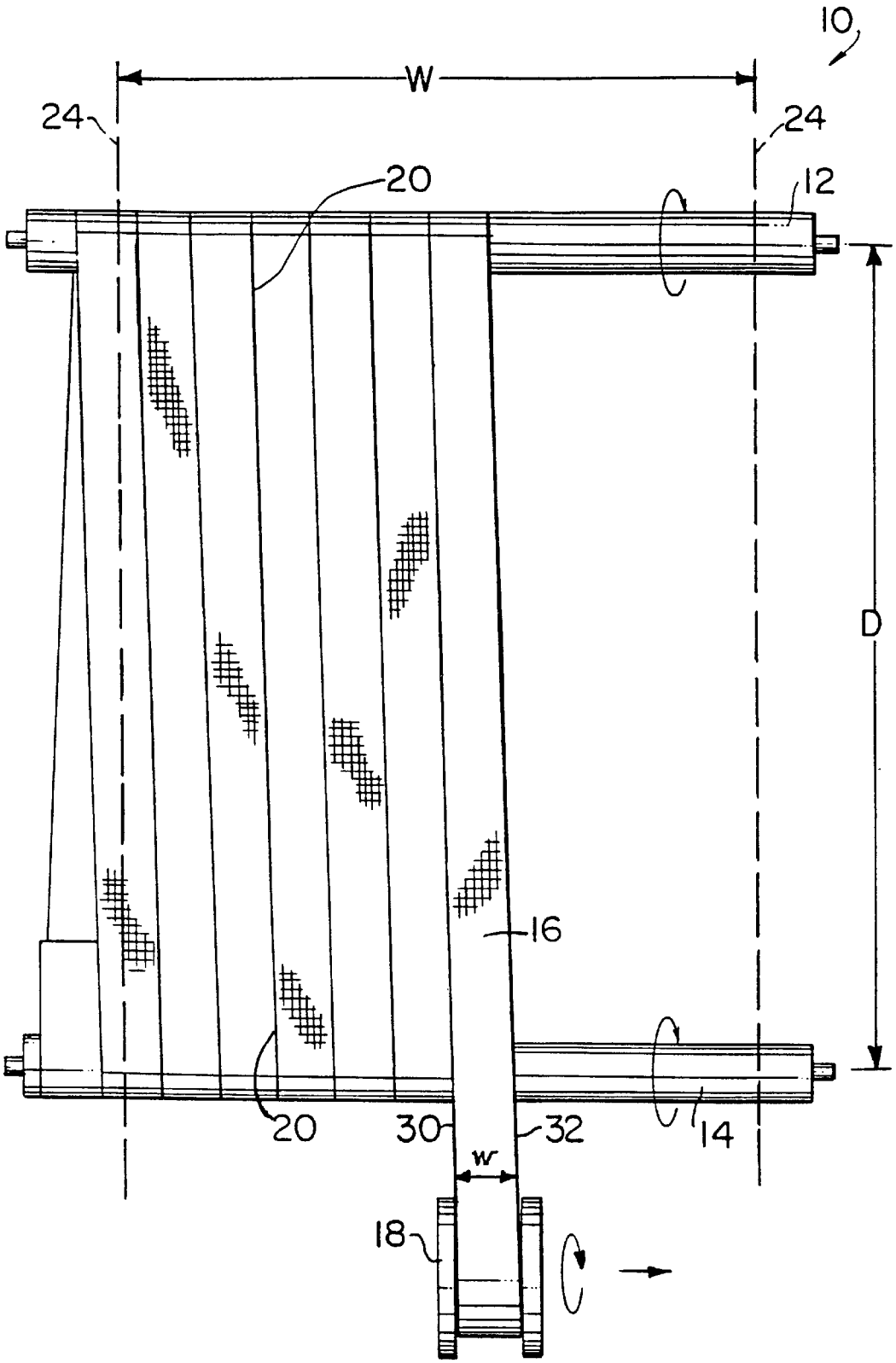
FIG. 1 is a schematic top plan view illustrating a method for manufacturing the press fabric of the present invention.

Referring now to these figures, FIG. 1 is a schematic top plan view illustrating a method for manufacturing a press fabric of the present invention. The method may be practiced using an apparatus 10 comprising a first roll 12 and a second roll 14, which are parallel to one another and which may be rotated in the direction indicated by the arrows. A laminated structure 16 in the form of a strip is wound from a stock roll 18 around the first roll 12 and the second roll 14 in a continuous spiral. It will be recognized that it may be necessary to translate the stock roll 18 at a suitable rate along second roll 14 (to the right in FIG. 1) as the laminated structure 16 is being wound around the rolls 12,14.

Figure 2:
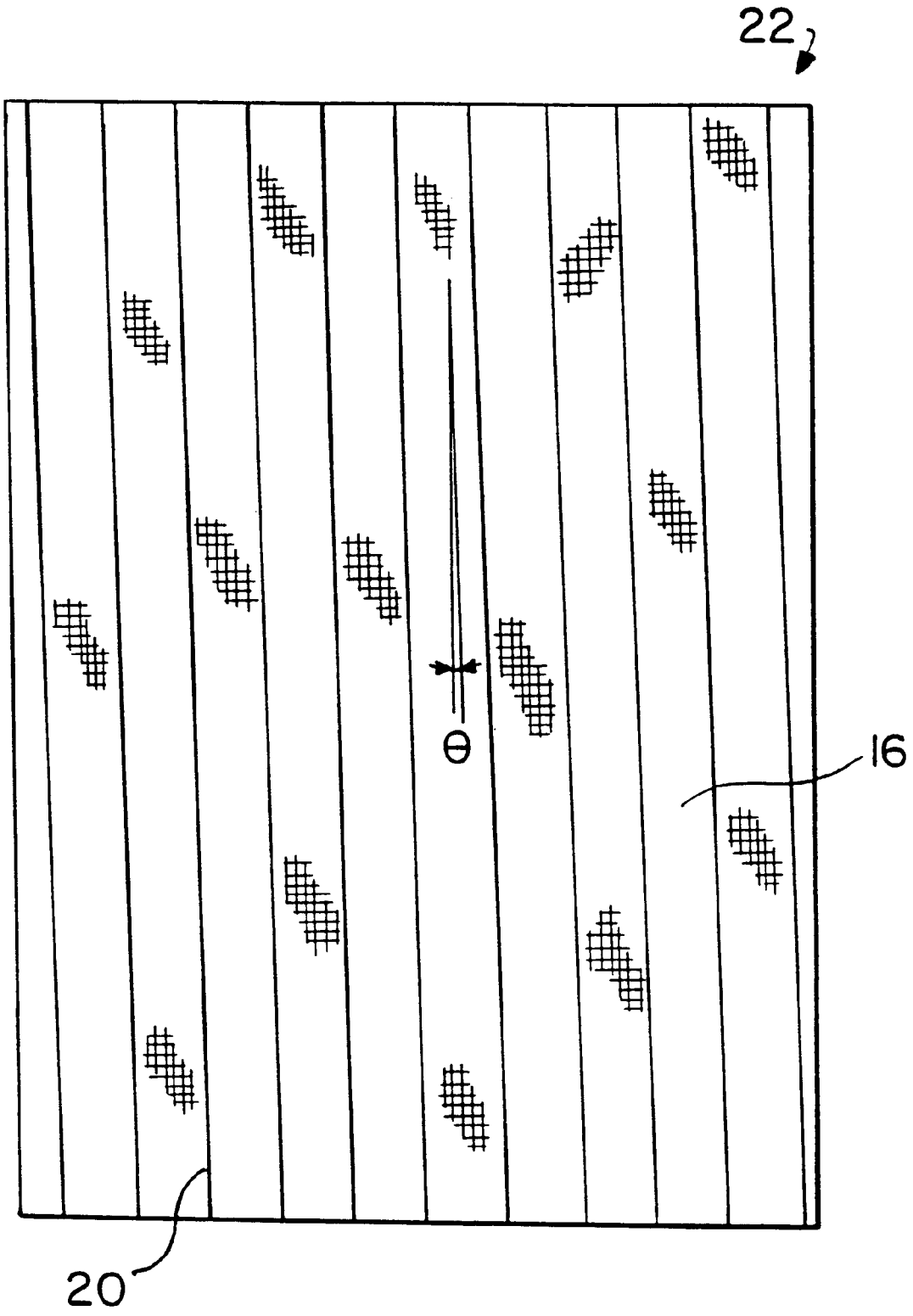
FIG. 2 is a top plan view of the press fabric.

The first roll 12 and the second roll 14 are separated by a distance, D, which is determined with reference to the total length, C, required for the press fabric being manufactured, the total length, C, being measured longitudinally (in the machine direction) about the endless-loop form of the press fabric. Laminated structure 16, having a width, w, is spirally wound onto the first and second rolls 12,14 in a plurality of turns from stock roll 18, which may be translated along the second roll 14 in the course of the winding. Successive turns of the laminated structure 16 are abutted against one another and are attached to one another along helically continuous seam 20 by sewing, stitching, melting, fusing or welding to produce press fabric 22 as shown in FIG. 2. Such attachment may be effected on either the inside or the outside of the endless loop formed by the press fabric 22, attachment on the inside being preferred. When a sufficient number of turns of the laminated structure 16 have been made to produce press fabric 22 in the desired width, W, that width being measured transversely (in the cross-machine direction) across the endless-loop form of the press fabric 22, the spiral winding is concluded. The press fabric 22 so obtained has an inner surface, an outer surface, a machine direction and a cross-machine direction. Initially, the lateral edges of the press fabric 22, it will be apparent, will not be parallel to the machine direction thereof, and must be trimmed along lines 24 to provide the press fabric 22 with the desired width, W, and with two lateral edges parallel to the machine direction of its endless-loop form Laminated structure 16, whose components and method of manufacture will be described in greater detail below, is, as previously mentioned, in the form of a strip of width, w. Preferably, the strip has a width of 39.4 inches (1.0 meter), although strips of greater or smaller width may prove to be useful in the practice of the present invention.

Because laminated structure 16 is spirally wound to assemble press fabric 22, helically continuous seam 20 does not align with the longitudinal, or machine, direction of the press fabric 22, but instead makes a slight angle, 0, whose magnitude is a measure of the pitch of the spiral windings of the laminated structure 16 with respect to the machine direction of the press fabric 22, as suggested by the top plan view thereof shown in FIG. 2. This angle, as previously noted, is typically less than 100.

Laminated structure 16 has a first lateral edge 30 and a second lateral edge 32 which together define its width, w. As the laminated structure 16 is being spirally wound onto first and second rolls 12,14, the first lateral edge 30 of each turn is abutted against the second lateral edge 32 of the immediately preceding turn, without overlapping, and joined thereto by sewing, stitching, melting, fusing or welding.

A laminated press fabric, incorporating press fabric 22 manufactured in the foregoing manner from laminated structure 16, may itself be manufactured by first mounting a base fabric of any of the standard varieties described above about first and second rolls 12,14, and by then spirally winding a strip of laminated structure 16 thereonto to produce a layer in the form of press fabric 22 on top of the base fabric in accordance with the procedure described above. Alternatively, or additionally, a further layer in the form of press fabric 22 may be manufactured by spirally winding a strip of laminated structure 16 onto that previously produced by spiral winding in accordance with the procedure described above. Preferably, such a layer would be manufactured by spirally winding the strip of laminated structure 16 in a direction opposite to that in which it was wound to produce the previous layer, so that in one layer the laminated structure 16 would spiral in one direction, producing a right-handed spiral, while in the other layer the laminated structure 16 would spiral in the other direction, producing a left-handed spiral.

Moreover, a laminated press fabric, incorporating press fabric 22 manufactured in the above-described manner from laminated structure 16, may also be manufactured by slipping press fabric 22 over a base fabric of any of the standard varieties described above and having suitably matched dimensions.

In any event, whether the press fabric is laminated or comprises only one layer produced by spirally winding laminated structure 16, one or more layers of staple fiber material may be applied to its outer surface, its inner surface, or to both of these surfaces, and driven thereinto by needling or hydroentangling. The one or more layers of staple fiber material may be in the form of a strip spiralled onto the press fabric or may be applied full-width onto the press fabric.

Where the press fabric has been laminated, individual fibers of the staple fiber material, driven through the overlying layers, are the primary means by which the layers are attached to one another. In any case, this additional batt improves the structural integrity of the press fabric and reduces the risk of sheet marking.

Alternatively, where the press fabric has been laminated, its layers may be attached to one another by placing a material having a relatively lower melting point between the layers, and by exposing the press fabric to heat, and optionally to pressure, to melt the material having the lower melting point and to bond or fuse the layers together. Glue could be used instead of the lower-melting-point material. Alternatively, one of the layers of laminated structure 16 could be of a lower-melting-point material.

Figure 3:
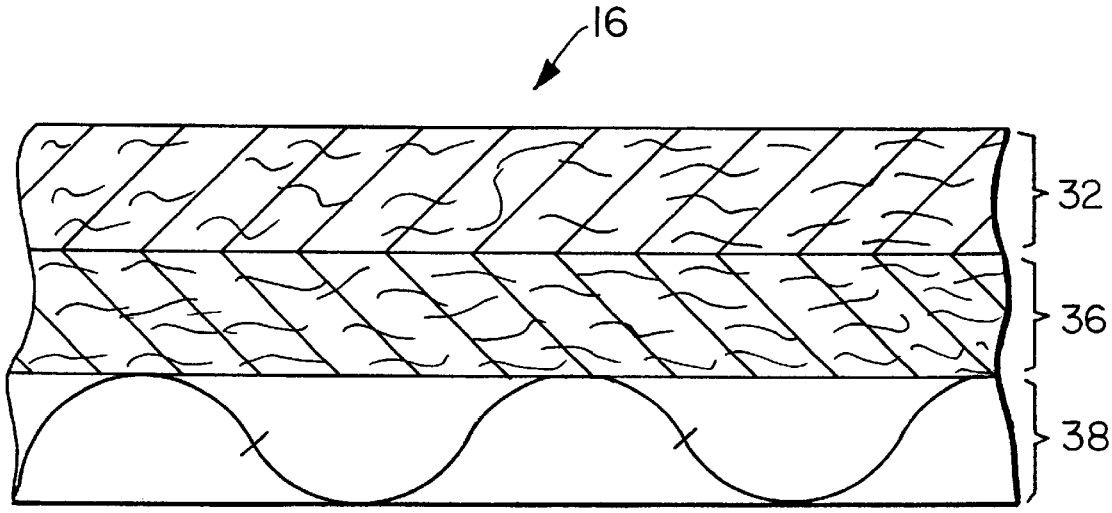
FIG. 3 is a diagrammatic cross section of a laminated structure from which the present invention is manufactured.

Turning now to the laminated structure 16, FIG. 3 is a diagrammatic cross-section thereof. The laminated structure 16 comprises at least two layers, and, as such, may comprise three layers, which, for the sake of convenience, will be identified as a top layer 34, an intermediate layer 36 and a bottom layer 38. It should be appreciated and understood that the top layer 34 forms the outer surface of press fabric 22 and contacts the wet paper web being manufactured on the paper machine.

As indicated above, top layer 34 comprises one of the materials selected from the group consisting of: staple fiber material; fabric woven from fibers or filaments fine enough not to mark a wet paper web; spun-bond, hydroentangled and melt-blown nonwoven fabrics; and apertured extruded polymeric films.

For example, top layer 34 may comprise a batt or batts of staple fiber material. Alternatively, top layer 34 may comprise a fabric, either woven or nonwoven, of fine yarns or filaments of a denier comparable to that of batt fiber and therefore not likely to seriously mark a wet paper web with which it comes into contact.

As such, top layer 34 may be a fine woven fabric of the variety disclosed in commonly assigned U.S. Pat. No. 5,525,410, the teachings of which are incorporated herein by reference. Alternatively, fine woven mesh products such as those produced and sold by Kanebo may also be used. Spun-bond nonwoven fabrics available from Cerex, and hydroentangled nonwoven fabrics available from Dupont under the name Sontara, may also be used. The latter materials are hydroentangled, very fine denier, polyester fiber materials. The melt-blown nonwoven fabrics of interest normally include polypropylene or polyethylene.

The top layer 34 may also comprise an apertured extruded polymeric film, such as apertured thermoplastic polyurethane (TPU) sheet material. The apertured TPU sheet material may have a density of from 140 to 850 g/m$^2$, a thickness of from 0.13 to 1.3 mm (5 to 50 mil), and a percent open area of from 20% to 60%. The apertures may have any shape, such as rectangular, square, circular and so forth.

The bottom layer 38 comprises one of the materials selected from the group consisting of the materials identified as being suitable for the top layer 34, plus knitted fabrics; nonwoven netting materials or mesh fabrics; and woven fabric strips. One or more of these last three materials (knitted fabrics; nonwoven netting materials or mesh fabrics; and woven fabric strips) are included when the bottom layer 38 is to carry out a load-bearing function on the paper machine and is to provide the papermaker's fabric with dimensional stability in both the machine and cross-machine directions.

As such, the bottom layer 38 may comprise a woven fabric strip, which may be woven from monofilament, plied monofilament or multifilament yarns of a synthetic polymeric resin, such as polyamide or polyester, in the same manner as other fabrics used in the papermaking industry are woven. After weaving, the woven fabric strip may be heat-set in a conventional manner prior to interim storage on a stock roll. Such a woven fabric strip includes lengthwise yarns and crosswise yarns, wherein, for example, the lengthwise yarns may be plied monofilament yarns while the crosswise yarns may be monofilament yarns, and may be of a single- or multi-layer weave. As above, the woven fabric strip may be a fine woven fabric of the variety disclosed in commonly assigned U.S. Pat. No. 5,525,410, or a fine woven mesh fabric of the variety sold by Kanebo.

Alternatively, the bottom layer 38 may comprise a strip of nonwoven mesh fabric of the variety disclosed in commonly assigned U.S. Pat. No. 4,427,734 to Johnson, the teachings of which are incorporated herein by reference. The nonwoven mesh fabric disclosed in this U.S. patent has a net-like structure of ribs or yarns defining a mesh. The monofilament-like elements making up the nonwoven mesh fabric are oriented in the lengthwise and crosswise directions thereof, although, alternatively, they may be oriented diagonally with respect to those directions. The nonwoven, mesh fabric is fabricated by extrusion or like techniques from thermoplastic resins, such as polyamide, polypropylene, polyethylene and the like. For example, nonwoven netting material available from Naltex and having strands with diameters in the range from 0.33 mm (0.013 inches or 13 mil) to 2.03 mm (0.080 inches or 80 mil) and counts of 3 to 16 strands per centimeter (7 to 40 strands per inch) may be used for this purpose. These materials are made from polyamide, polyester, polypropylene and polyethylene.

The laminated structure 16 may also comprise an intermediate layer 36 which comprises at least one of the materials identified above for the top or bottom layer 38. One or more of the materials: a) knitted fabrics; b) nonwoven netting materials or mesh fabrics; and c) woven fabric strips, are included when the intermediate layer 36 is to carry out a load-bearing function on the paper machine and is to provide the papermaker's fabric with dimensional stability in both the machine and cross-machine directions.

The top layer 34 and bottom layer 38 or the top layer 34, intermediate layer 36, and bottom layer 38, are joined to one another to form the laminated structure 16 used to manufacture press fabric 22. In this regard, considerable lengths of the laminated structure 16 may be manufactured and set aside for subsequent use in manufacturing press fabric 22 to the size specifications required by customers. The two layers 34,38 (top, bottom), or the three layers 34,36,38 (top, intermediate, bottom), are joined to one another by needling, fusing, melting, gluing or other processes well-known to those of ordinary skill in the art for joining fabric layers to one another. Once so joined, it may be necessary to trim the lateral edges of the resulting laminated structure 16 to make them uniformly parallel to one another and to provide the laminated structure 16 with a uniform width, w.

As with other types of press fabrics, subsequent manufacturing steps known in the art, such as washing, drying, surfacing, precompacting and so forth, may be carried out to complete the manufacture of press fabric 22 of the present invention.

With the present invention, the need to bond full-width structures to one another to produce a laminated structure may be eliminated. Instead, the laminated structure is first manufactured in a relatively narrow width, and subsequently used to assemble full-width structures by a spiral winding technique. The laminated structure, in the form of a strip, may be manufactured quickly and later used for this purpose.

Modifications to the above would be obvious to one of ordinary skill in the art, but would not bring the invention so modified beyond the scope of the appended claims.

What is claimed is:

1. A method for manufacturing a press fabric or the press section of a paper machine, said method comprising the steps of:

providing a strip of a laminated structure, said strip having at least two separate and distinct layers which are attached together, a first lateral edge and a second lateral edge, and a strip width measured transversely thereacross, said strip width being less than that of said press fabric;

spirally winding said strip of said laminated structure in a plurality of non-overlapping turns;

abutting each turn of said strip of said laminated structure against that previously wound; and joining each turn of said strip of said laminated structure to that previously wound to form said press fabric, said press fabric being in the form of an end less loop having an inner surface and an outer surface.

2. A method as claimed in claim 1 wherein said step of providing a strip of a laminated structure comprises the steps of:

providing a bottom layer, said bottom layer being a base for said laminated structure;

providing a top layer, said top layer being adapted to support a paper web in the press section of a paper machine;

placing said top layer atop said bottom layer; and attaching said top and bottom layers together to form said laminated structure.

3. A method as claimed in claim 2 further comprising the steps of:

providing an intermediate layer; and placing said intermediate layer between said top and bottom layers before attaching said top and bottom layers together.

4. A method as claimed in claim 2 wherein said step of attaching is performed by needling.

5. A method as claimed in claim 2 wherein said step of attaching is performed by gluing.

6. A method as claimed in claim 2 wherein said step of attaching is performed by fusing.

7. A method as claimed in claim 2 wherein said step of attaching is performed by melting.

8. A method as claimed in claim 1 further comprising the step of trimming said first lateral edge and said second lateral edge to make said edges parallel to one another and to make said strip width uniform.

9. A method as claimed in claim 1 further comprising the step of attaching at least one additional layer of staple fiber material to said press fabric.

10. A method as claimed in claim 9 wherein said attaching step is carried out on said inner surface of said press fabric.

11. A method as claimed in claim 9 wherein said attaching step is carried out on said outer surface of said press fabric.

12. A method as claimed in claim 9 wherein said attaching step is carried out on said inner surface and on said outer surface of said press fabric.

13. A method as claimed in claim 9 wherein said at least one additional layer of staple fiber material is in the form of a strip spiralled onto one of said inner and outer surfaces of said press fabric.

14. A method as claimed in claim 9 wherein said at least one additional layer of staple fiber material is applied full-width onto one of said inner and outer surfaces of said press fabric.

15. A method as claimed in claim 1 further comprising the step of providing a base fabric for said press fabric, said base fabric being in the form of an endless loop, said endless loop having an inner surface, an outer surface, a first and a second lateral edge, and a fabric width measured transversely between said lateral edges, and wherein said strip of said laminated structured is spirally wound in a plurality of non-overlapping turns upon said outer surface of said base fabric.

16. A method as claimed in claim 1 further comprising the steps of:

providing a base fabric for said press fabric, said base fabric being in the form of an endless loop said endless loop having an inner surface, an outer surface, a first and a second lateral edge, and a fabric width measured transversely between said lateral edges; and slipping said base fabric inside said press fabric.

17. A method as claimed in claim 1 further comprising the steps of:

providing a second strip of a laminated structure, said second strip having at least two distinct layers laminated together, a first lateral edge and a second lateral edge, and a strip width measured transversely thereacross, said strip width being less than that of said press fabric;

spirally winding said second strip of said laminated structure in a plurality of non-overlapping turns upon said press fabric;

abutting each turn of said second strip of said laminated structure against that previously wound; and joining each turn of said second strip of said laminated structure to that previously wound to form a layer on said press fabric.

18. A method as claimed in claim 17 wherein said step of providing a second strip of a laminated structure comprises the steps of:

providing a bottom layer, said bottom layer being a base for said laminated structure;

providing a top layer, said top layer being adapted to support a paper web in the press section of a paper machine;

placing said top layer atop said bottom layer; and attaching said top and bottom layers together to form said laminated structure.

19. A method as claimed in claim 18 further comprising the steps of:

providing an intermediate layer; and placing said intermediate layer between said top and bottom layers before attaching said top and bottom layers together.

20. A method as claimed in claim 18 wherein said step of attaching is performed by needling.

21. A method as claimed in claim 18 wherein said step of attaching is performed by gluing.

22. A method as claimed in claim 18 wherein said step of attaching is performed by fusing.

23. A method as claimed in claim 18 wherein said step of attaching is performed by melting.

24. A method as claimed in claim 17 wherein said second strip of said laminated structure is spirally wound in a direction opposite to that in which said strip of said press fabric is wound.

25. A press fabric for the press section of a paper machine, said press fabric comprising:

a strip of a laminated structure, said strip having at least two separate and distinct layers which are attached together, said layers being a top layer and bottom layer, said strip further having a first lateral edge, a second lateral edge and a strip with measured transversely thereacross, said strip width being less than that of said press fabric, aid strip being spirally wound in a plurality of contiguous turns wherein said first lateral edge in a turn of said strip abuts said second lateral edge of an adjacent turn thereof, thereby forming a helically continuous seam separating adjacent turns of said strip, said helically continuous seam being closed by attaching abutting first and second lateral edges of said strip to on another.

26. A press fabric as claimed in claim 25 wherein said laminated structure further comprises an intermediate layer sandwiched between said top and bottom layers.

27. A press fabric as claimed in claim 25 further comprising at least one additional layer of staple fiber material attached to one of the inner and outer surfaces of said press fabric.

28. A press fabric as claimed in claim 25 wherein at least one additional layer of staple fiber material is attached to each of said inner and outer surfaces of said press fabric.

29. A press fabric as claimed in claim 27 wherein said at least one additional layer of staple fiber material is in the form of a strip spiralled onto one of said inner and outer surfaces of said press fabric.

30. A press fabric as claimed in claim 27 wherein said at least one additional layer of staple fiber material is applied full-width onto one of said inner and outer surfaces of said press fabric.

31. A press fabric as claimed in claim 25 further comprising a base fabric in the form of an endless loop, said endless loop having an inner surface and an outer surface, wherein said strip of said laminated structure is spirally wound upon said outer surface of said base fabric.

32. A press fabric as claimed in claim 25 further comprising a base fabric in the form of an endless loop, said endless loop having an inner surface and an outer surface, wherein said base fabric is inside said press fabric.

33. A press fabric as claimed in claim 25 further comprising a second strip of said laminated structure, said second strip being spirally wound in a plurality of contiguous turns upon said spirally wound strip, wherein said first lateral edge in a turn of said second strip abuts said second lateral edge of an adjacent turn thereof, thereby forming a helically continuous seam separating adjacent turns of said second strip, said helically continuous seam being closed by attaching abutting first and second lateral edges of said second strip to one another.

34. A press fabric as claimed in claim 25 wherein said top layer of said laminated structure comprises one of the materials selected from the group consisting of: staple fiber material; fabric woven from fibers or filaments; spun-bond, hydroentangled and melt-blown nonwoven fabrics; and apertured extruded polymeric film.

35. A press fabric as claimed in claim 25 wherein said bottom layer of said laminated structured comprises one of the materials selected from the group consisting of: staple fiber material; fabric woven from fibers or filaments; spun-bond, hydroentangled and melt-blown nonwoven fabrics; apertured extruded polymeric films; knitted fabrics; nonwoven netting materials or mesh fabrics; and woven fabric strips.

36. A press fabric as claimed in claim 26 wherein said intermediate layer of said laminated structured comprises one of the materials selected from the group consisting of: staple fiber material; fabric woven from fibers or filaments; spun-bond, hydroentangled and melt-blown nonwoven fabrics; apertured extruded polymeric films; knitted fabrics; nonwoven netting materials or mesh fabrics; and woven fabric strips.

* * * * *